United States Patent [19]

Conboy

[11] Patent Number: 5,037,686

[45] Date of Patent: Aug. 6, 1991

[54] DRY WALL TAPE

[76] Inventor: John S. Conboy, 215 Cedar Tree La., Ballwin, Mo. 63011

[21] Appl. No.: 385,718

[22] Filed: Jul. 27, 1989

[51] Int. Cl.[5] ..... B32B 3/02; B32B 3/10

[52] U.S. Cl. ..... 428/43; 428/134; 428/182; 428/906; 428/156; 52/417; 156/71

[58] Field of Search ..... 428/906, 134, 182, 157, 428/43, 156; 52/417; 156/71

[56] References Cited

U.S. PATENT DOCUMENTS 2,181,530 11/1939 Davenport ..... 52/417

2,314,523 3/1943 Speer ..... 52/417

FOREIGN PATENT DOCUMENTS 18015 of 1929 Australia ..... 52/417

*Primary Examiner*—Alexander S. Thomas

*Attorney, Agent, or Firm*—Gravely, Lieder & Woodruff

[57] ABSTRACT

A dry wall tape having a curved center section, reversely curved intermediate sections and outwardly tapering wings terminating in a thin edge. The tape can be used on inside and outside corner joints to obtain a straight line. Preferably the tape has triangular cut outs in the wings and removable end strips along the outer edges of the tape to facilitate taping of curved corners.

11 Claims, 3 Drawing Sheets

FIG. 1
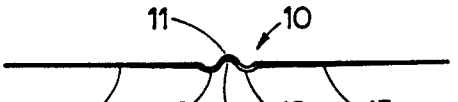
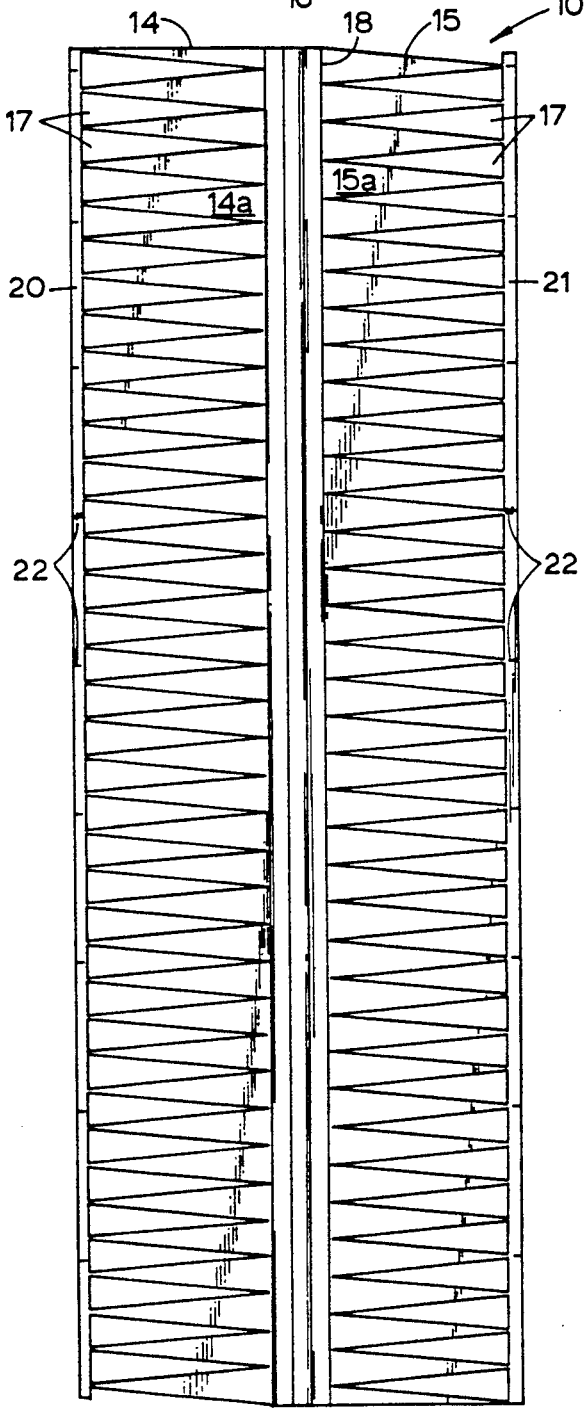
FIG. 2
FIG. 3
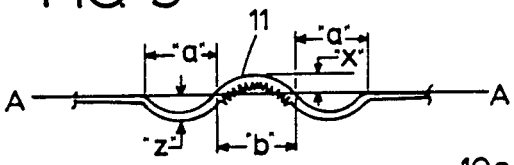
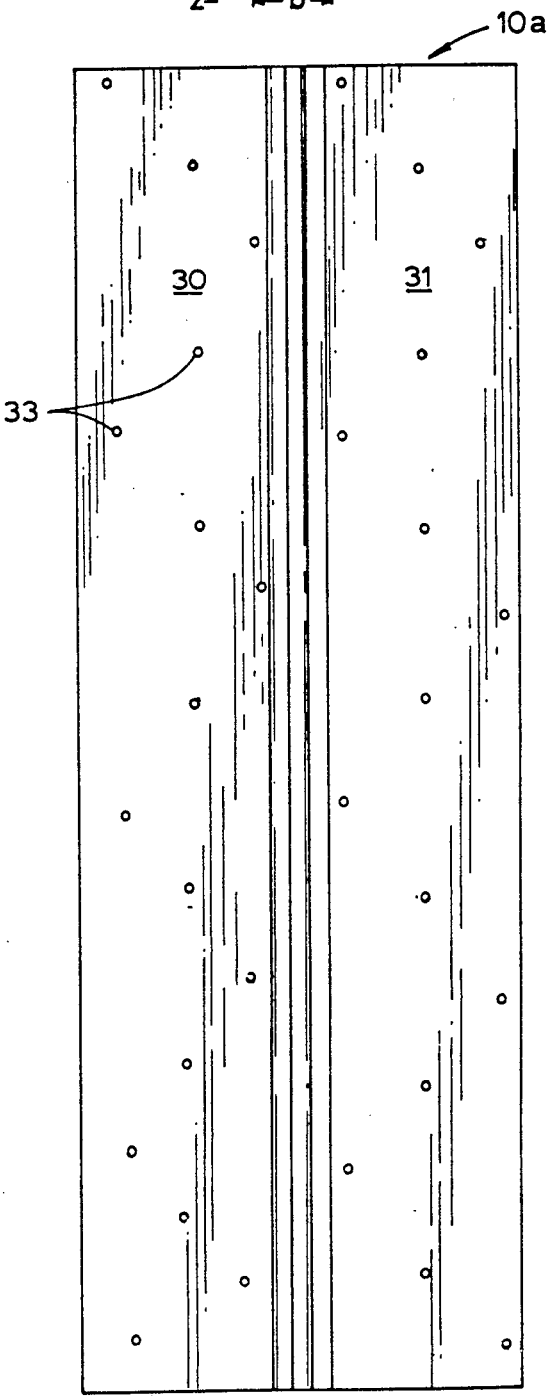
FIG. 4

DRY WALL TAPE

BACKGROUND OF THE INVENTION

This invention relates to dry wall tapes and particularly relates to a novel dry wall plastic tape which is suitable for application to inside and outside corners of coffered ceilings, bay windows, and any other angular dry wall application. This invention is also applicable for use on curved openings, arched dry wall openings and curved dry wall walls.

Currently it is very difficult to form a straight line along inside corners of rooms constructed with dry wall board. There is available beaded tape which is suitable for use on outside corners, but it takes a skilled and patient craftsman to form a uniformly straight line on an inside corners, such as are found in coffered ceilings and bay windows, and along curved arches and arched openings.

Accordingly, it is a principal object of this invention to provide a dry wall plastic tape which can be used for both inside and outside corners as well as being usable for curved or arched openings. It is a principal object of this invention to provide a dry wall tape which will allow the person taping to rapidly form a straight line on an inside corner and which tape can also be applied to outside corners. It is still a further object to provide such a tape which also is applicable to curved openings such as are found on rounded half walls, curved stair wells, and arched dry wall openings.

These and other objects and advantages will become apparent hereinafter.

SUMMARY OF THE INVENTION

The present invention comprises a tape having an outwardly arched center section and reversely curved intermediate sections with laterally extending relatively flat wings along the side edges of the tape.

The invention also consists in the parts and in the arrangements and combinations of parts hereinafter described and claimed.

DESCRIPTION OF THE DRAWINGS

In the accompanying drawings which form part of the specification and wherein like numbers and letters refer to like parts wherever they occur FIG. 1 is an end elevational view of one form of this invention;

FIG. 2 is a top plan view of the invention shown in FIG. 1.;

FIG. 3 is a fragmentary enlarged end elevational view of a second form of the invention;

FIG. 4 is a top plan view of the form of the invention shown in FIG. 3;

DETAILED DESCRIPTION

Figure 5:
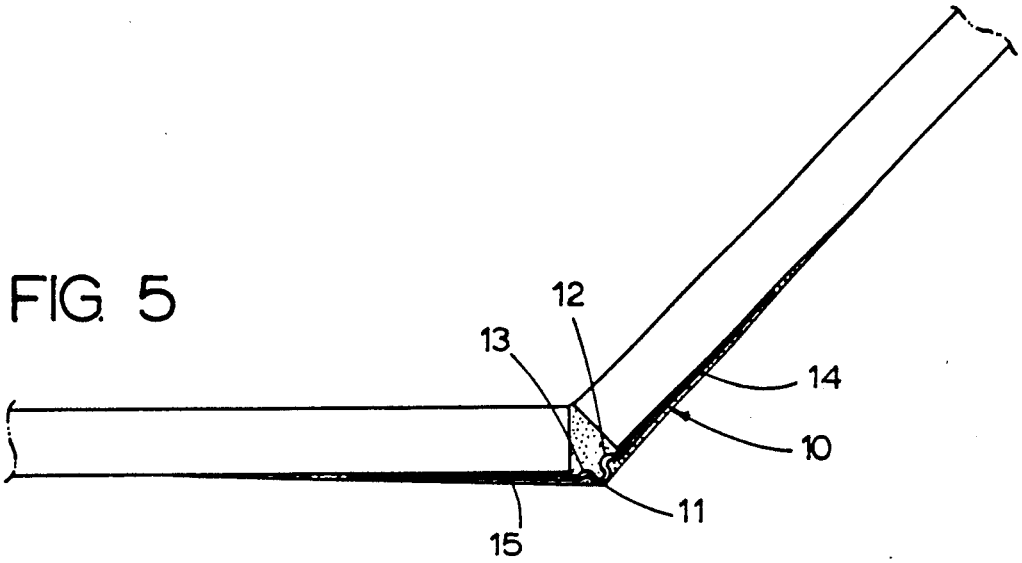
FIG. 5 is a fragmentary end elevational view of the tape applied to an outside corner.

The preferred form of the invention is shown in FIGS. 1 and 2 and the tape 10 comprises an arched center section 11 and reversely arched intermediate sections 12 and 13 connecting the arched center section 11 with outwardly extending wings 14 and 15. The arched center section 11 preferably is provided with internal serrations 16 on the inside of the arch to facilitate bending. This is shown in more detail in FIG. 3.

The top of the arch section 11 preferably is about 1/16" to about 3/32" above the plane of the wings 14, 15 as identified by the line A—A in FIG. 3. This distance is denoted by the letter "x". The outermost parts of the intermediate sections 12, 13 preferably are about 1/16" to about 3/32" below the line A—A. This distance is identified by the letter "z" in FIG. 3. The intermediate sections 12, 13 are about 5/64" to about 3/32" in width as shown by the letter "a" in FIG. 3. The arch center section 11 is about 3/32" to about ⅛" in width as shown by the letter "b" in FIG. 3.

The outwardly depending and diverging wings 14 and 15 preferably are provided with V-shaped notches 17 (FIG. 2) which have their apex 18 at the point of connection to the intermediate sections 12 and 13 and their widest part is most remote from the center arched section 11. The notches 17 thus define adjacent triangular solid members **14*a* and 15*a* on the respective wings 14 and 15**.

Figure 7:
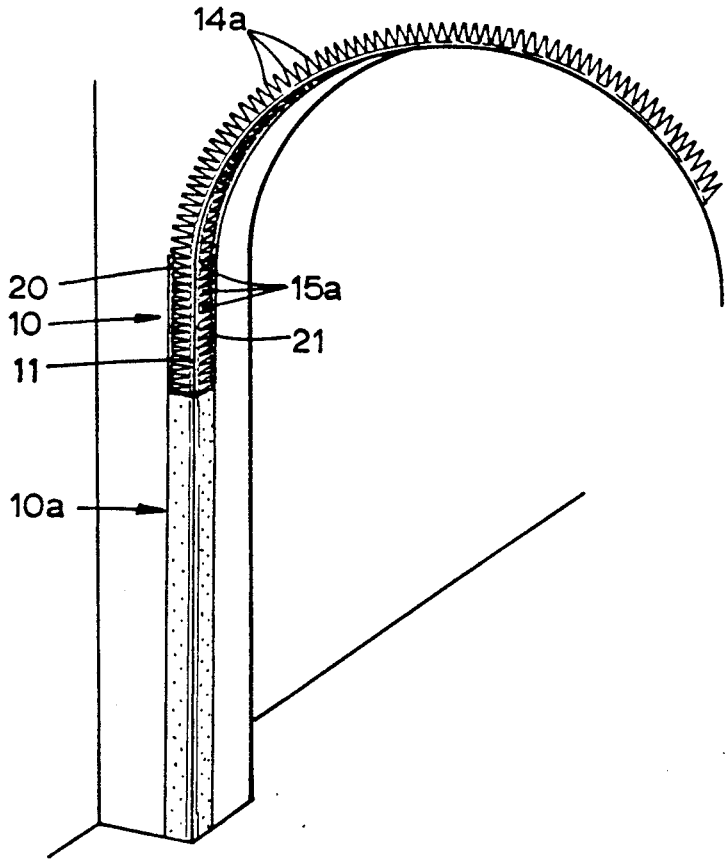
FIG. 7 is a fragmentary perspective view of the tape of FIGS. 1 and 2 applied to an arched opening.
Figure 8:
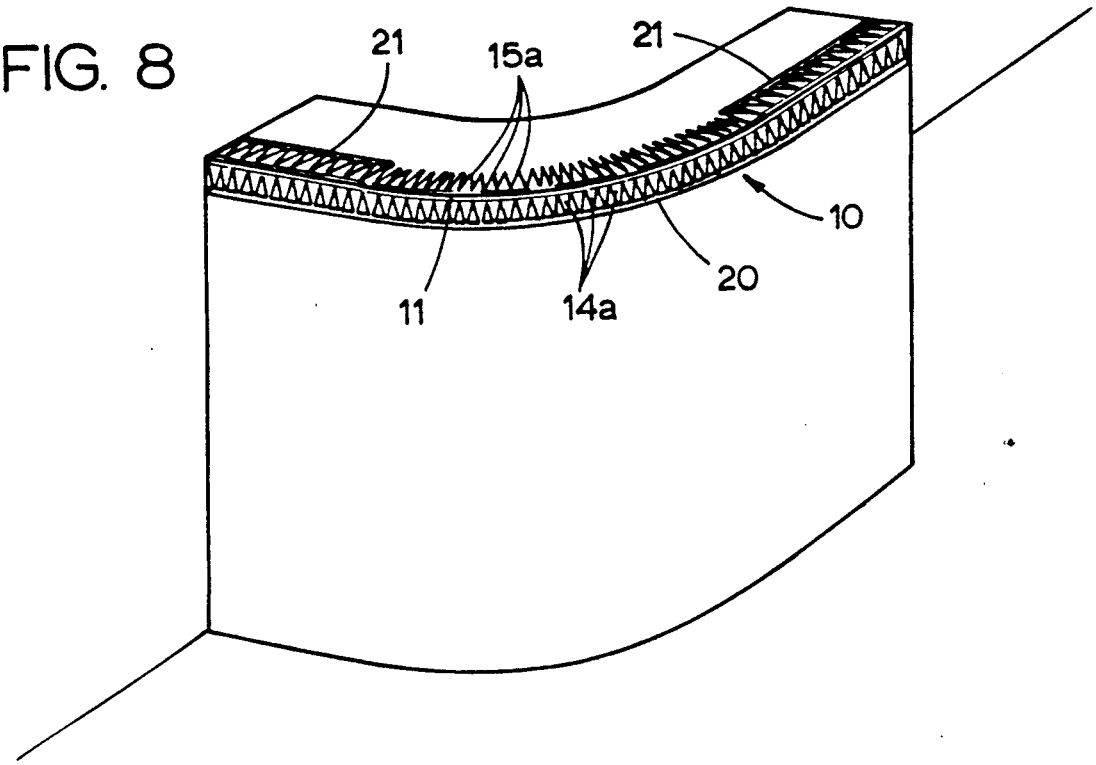
FIG. 8 is a fragmentary perspective view of the tape applied to a rounded wall.
Figure 9:
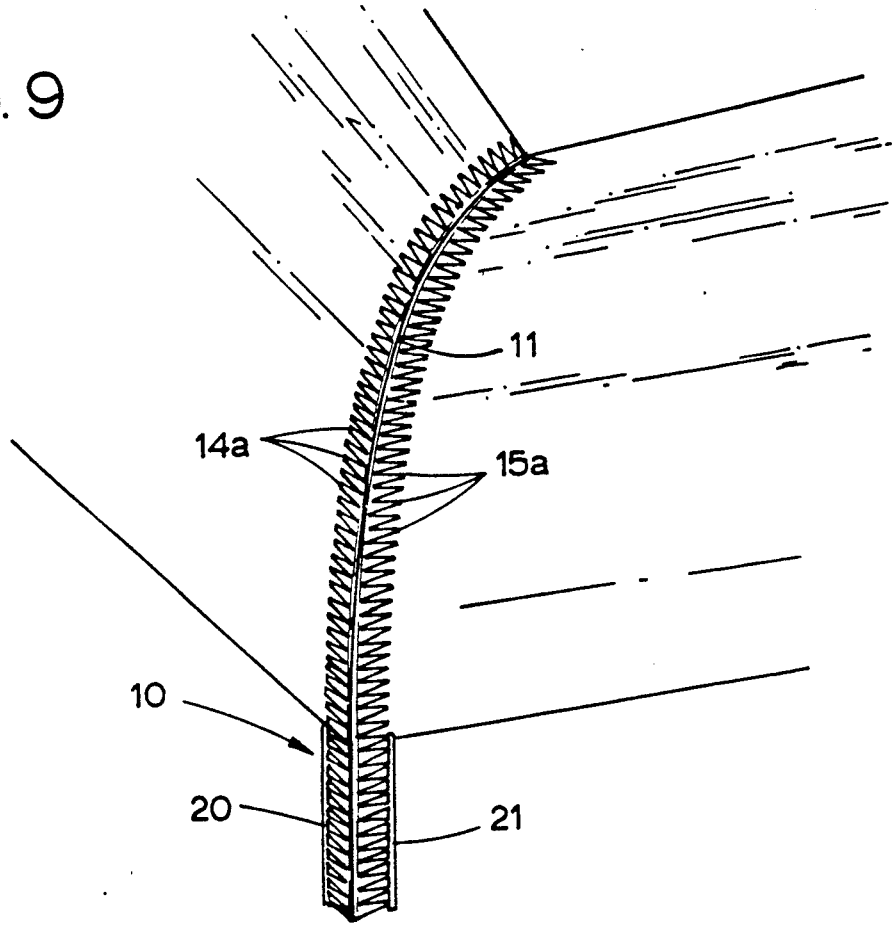
FIG. 9 is a fragmentary enlarged perspective view of the tape applied to a curved corner joint.

The notches 17 in each depending wing 14 and 15 are staggered so that the apex of a notch 17 on wing 14 is aligned with approximately the center of the triangularly shaped solid member **15*a* of the opposed wing 15. Thus the wings 14 and 15 are formed of a continuous series of triangularly shaped pieces 14*a*, 15*a* which are connected at their widest part to the intermediate sections 12 and 13. At the point on the triangular pieces 14*a*, 15*a* which is most remote from the center section 11 and along the outer edges of the tape 10 are releasible and removable tear strips 20, 21. The purpose for the tear strips 20, 21 is to allow the notches 17 to separate when the tape 10 is applied to an arched or rounded opening or corner as shown in FIGS. 7–9. The pieces 15*a* on the inner side of the curved corner gather together as also seen in FIG. 9**.

Preferably the wings 14 and 15 are about 3/64" to about 1/16" in thickness where they join the intermediate sections 12, 13, and taper outwardly rom this point of connection toward their connection with the tear strips 20 and 21. The tear strips 20, 21 preferably are about 1/64" to about 1/32" in thickness. Thus, it is easier to provide a smooth finish to the joint because the wings 14, 15 are very thin and get thinner the further they extend away from the corner.

The wings 14, **14*a* are marked with suitable indicia 22 each foot and are scribed every inch. These markings are on the tear strips 20, 21 in the form of the invention shown in FIGS. 1 and 2**.

The wings 14, 15 preferably are about 1½" to about 1¾" in width and the tear strips 20, 21 are preferably about 1/16" to about 3/32" in width. The sold triangular members **14*a*, 15*a* preferably have a width of about 3/16" to about ¼" at their point of intersection with the intermediate members 12, 13**.

The tape **10*a* shown in FIGS. 3 and 4 is applicable to straight line joints and is not designed for use with curved openings. In this tape 10*a*, the wings 30 and 31 are solid and do not have V-shaped grooves or the tear strip. The wings 30, 31 preferably are tapered however and have the same dimensions as hereinbefore discussed for the tape 10. The wings 30, 31 have indentations, serrations or perforation 33** or other roughening effects, such as that caused by chemical or physical etching randomly positioned on the outer surface to help the dry wall compound adhere to the tape.

The tapes 10, 10*a* preferably are made of an extruded polymeric material. The tape should have some rigidity, and should be deformable to hold the shape it is formed into on the corner and also should adhere to the dry wall compound.

FIG. 5 shows the tape 10 applied to an outside joint and in the process of applying the tape 10, dry wall compound is applied to the joint before the tape 10 is placed along the joint. After the tape 10 has been placed along the joint so that the center section 11 protrudes outwardly from the joint, the dry wall compound is applied to the outside of the tape with a tape knife. The tape knife is guided on the protruding center section 11 so that a straight line is formed at the center of the joint. The tape knife, of course, also feathers the joint compound out over the free edge of the tape wings 14 and 15.

Figure 6:
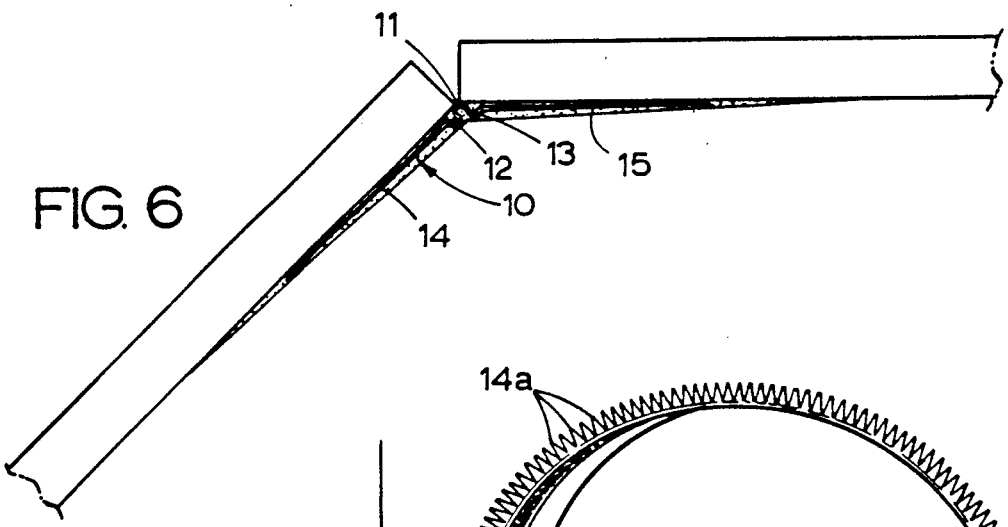
FIG. 6 is a fragmentary end elevational view of the tape applied to an inside corner.

FIG. 6 shows the tape 10 applied to an inside joint. In this application, the center arch 11 is positioned adjacent to the joint and the intermediate sections 12 and 13 protrude outwardly away from the joint. In applying the tape 10 to the inside joint, the joint compound is first applied and then the tape 10 is positioned so that the center member 11 is adjacent to the joint. The joint compound is then smoothed and formed into a straight line by guiding the taping knife on the protruding intermediate sections 12 and 13.

FIGS. 7–9 show the tape 10 of FIGS. 1 and 2 applied to curved joints. The pull away sections 20, 21 of the tape 10 are removed from that part of the tape 10 which is curved around the joint, so that it facilitates the V-shaped grooves 17 opening up or closing depending on whether they are inside or outside the curve. The taping proceeds in a similar fashion to that previously described depending on whether the curve is an inside or outside curve.

This invention is intended to cover all changes and modifications of the example of the invention herein chosen for purposes of the disclosure which do not constitute departures from the spirit and scope of the invention.

What is claimed is:

1. A dry wall tape adapted to be used on both inside and outside corners comprising:

a) an arched center section extending outwardly from the lateral centerline of the tape in a first direction, said center section acts as a corner bead when the tape is applied to an outside corner, b) reversely arched intermediate sections, connected to each edge of the center section and extending outwardly from the lateral centerline of the tape in a second direction opposed to the direction of the center section, said intermediate sections protrude from the wall when the tape is applied to an inside corner to guide the taping knife on a straight line when applying dry wall compound, c) said arched sections being sufficiently flexible to permit bending around a corner and sufficiently rigid to retain their shape and withstand taping pressure applied by the taper's tool, and d) depending wings connected at one edge to and extending outwardly in laterally diverging relation from the intermediate sections so as to define the lateral centerline of the tape, said wing sections having flat upper surfaces devoid of curved areas.

2. The tape of claim 1 wherein the material is a flexible polymeric material.

3. The tape of claim 1 wherein the wings are provided with means for adhering to dry wall compound.

4. A dry wall tape adapted to be used on both inside and outside corners comprising:

a) an arched center section having serrations on the inner surface to facilitate bending thereof, b) reversely arched intermediate sections, connected to each edge of the center section, and c) depending wings connected at one edge to and extending outwardly in diverging relation from the intermediate sections.

5. The tape of claim 4 wherein the V-shaped cut outs in the wings are staggered opposite to each other such that the apex of a cut out on one wings is located opposite to approximate center of the base of a triangular piece on the opposed wing.

6. The tape of claim 4 wherein the wings have removable tear strips along the free edges of the wings which are removed when taping a curved surface.

7. A dry wall tape adapted to be used on both inside and outside corners comprising:

a) an arched center section, b) reversely arched intermediate sections, connected to each edge of the center section, and c) depending wings connected at one edge to and extending outwardly in diverging relation from the intermediate sections, said wings being provided with V-shaped cut outs to facilitate bending the tape along an arch.

8. The tape of claim 7 wherein the wings have removable tear strips along the free edges of the wings which are removed when taping a curved surface.

9. A dry wall construction comprising:

(a) a first room wall, (b) a second room wall angularly positioned with respect to the first room wall to define a corner therebetween that needs to be finished with dry wall tape and dry wall compound, (c) a dry wall tape positioned over said corner, the said dry wall tape comprising (1) an arched center section extending outwardly from the lateral centerline of the tape in a first direction, said center section being positioned along said corner, (2) reversely arched intermediate sections connected to each edge of the center section and extending outwardly from the lateral centerline of the tape in a second direction opposed to the direction of the center section, (3) said arched sections being sufficiently flexible to permit bending around said corners and sufficiently rigid to retain their shape and withstand taping pressure applied by the taper's tool, and (4) depending wings connected at one edge and extending outwardly in laterally diverging relation from the intermediate sections so as to define the lateral centerline of the tape, (a) the wings having a flat surface devoid of curved areas, and (d) dry wall compound positioned over the tape to define smooth surfaces from the ends of the wings to the center of the center section and terminating in a straight line at the corner between the two walls.

10. A method of taping an inside corner defined by a first room wall and a second room wall angularly positioned with respect to the first room wall to define a relatively closed corner therebetween, the room walls defining an angle of 90° or more comprising the steps of:

(a) applying dry wall compound to the wall areas adjacent to the corner and along the corner, (b) applying a dry wall tape to the corner, said dry wall tape having (1) an inwardly arched center section aligned with and adjacent to the wall corner, (2) reversely arched intermediate sections, (3) outwardly extending wing sections having a flat upper surface devoid of curved areas, and (4) said arched sections being sufficiently flexible to permit bending around said corners and sufficiently rigid to retain their shape and withstand taping pressure applied by the taper's tool, (c) applying additional dry wall compound to the tape to fill the space behind the center section, and (d) smoothing the dry wall compound over the tape wings using the outermost curved areas of the intermediate sections as guides to define a straight corner over the center section.

11. A method of taping an outside corner defined by a first room wall and a second room wall angularly positioned with respect to the first room wall at an outside angle of 180° or greater to define a joint therebetween which has a "V" shape comprising the steps of (a) applying dry wall compound to the walls adjacent to the corner and filling the joint, (b) applying a dry wall tape to the corner, said dry wall tape having (1) an outwardly arched center section which is positioned over the corner and aligned therewith and which protrudes outwardly from the corner, (2) reversely arched intermediate sections, said intermediate sections being positioned in the dry wall compound in the joint, (3) outwardly extending wing sections having flat upper surfaces devoid of curved areas, and (4) said arched sections being sufficiently flexible to permit bending around said corners and sufficiently rigid to retain their shape and withstand taping pressure applied by the taper's tool, (c) applying additional dry wall compound over the tape, and (d) smoothing the drying compound over the tape wings using the center of the center section as a guide to define a straight corner.

* * * * *